US005630709A

United States Patent [19]

Bar-Cohen

[11] Patent Number: 5,630,709

[45] Date of Patent: May 20, 1997

[54] PUMP HAVING PISTONS AND VALVES MADE OF ELECTROACTIVE ACTUATORS

[75] Inventor: Yoseph Bar-Cohen, Seal Beach, Calif.

[73] Assignee: California Institute of Technology, Pasadena, Calif.

[21] Appl. No.: 600,326

[22] Filed: Feb. 9, 1996

[51] Int. Cl.[6] ..... F04B 43/04; F04B 19/00; F04B 39/08

[52] U.S. Cl. ..... 417/322; 417/417; 417/488; 417/505

[58] Field of Search ..... 417/322, 413.2, 417/417, 487, 488, 505

[56] References Cited

U.S. PATENT DOCUMENTS 2,785,638 3/1957 Moller ..... 417/505
4,558,995 12/1985 Furukawa et al. ..... 417/413.2
4,939,405 7/1990 Okuyama et al. ..... 417/413.2

*Primary Examiner*—Charles G. Freay
*Attorney, Agent, or Firm*—Michaelson & Wallace

[57] ABSTRACT

The present invention provides a pump for inducing a displacement of a fluid from a first medium to a second medium, including a conduit coupled to the first and second media, a transducing material piston defining a pump chamber in the conduit and being transversely displaceable for increasing a volume of the chamber to extract the fluid from the first medium to the chamber and for decreasing the chamber volume to force the fluid from the chamber to the second medium, a first transducing material valve mounted in the conduit between the piston and the first medium and being transversely displaceable from a closed position to an open position to admit the fluid to the chamber, and control means for changing a first field applied to the piston to displace the piston for changing the chamber volume and for changing a second field applied to the first valve to change the position of the first valve.

31 Claims, 2 Drawing Sheets

| STEP | INPUT SIGNALS 145 | | | OUTPUT SIGNALS 155 | | |
|---|---|---|---|---|---|---|
| | SENSOR 140a (VALVE 120) | SENSOR 140b (PISTON 125) | SENSOR 140c (VALVE 135) | SIGNAL 155a (VALVE 120) | SIGNAL 155b (PISTON 125) | SIGNAL 155c (VALVE 135) |
| 1. | OPEN | CONTRACTED | CLOSED | START TO CLOSE | — | START TO OPEN |
| 2. | CLOSED | CONTRACTED | OPEN | — | START TO EXPAND | — |
| 3. | CLOSED | EXPANDED | OPEN | START TO OPEN | — | START TO CLOSE |
| 4. | OPEN | EXPANDED | CLOSED | — | START TO CONTRACT | — |

FIG. 2

PUMP HAVING PISTONS AND VALVES MADE OF ELECTROACTIVE ACTUATORS

ORIGIN OF INVENTION

The invention described herein was made in the performance of work under a NASA contract, and is subject to the provisions of Public Law 96-517 (35 USC 202) in which the Contractor has elected to retain title.

BACKGROUND OF THE INVENTION

1. Technical Field

The present invention relates to a pump having pistons and valves made of electroactive actuators. Specifically, the invention relates to a miniature pump in which the valves and pistons comprise novel actuators made of transducing materials such as magnetostrictive or electroactive materials.

2. Background Art

Conventional pumps use numerous moving parts that are subject to wear and material fatigue which circumstances customarily lead to failure of the parts and disablement of the pump. Moving parts also result in pump failure because of jamming or fracture of the parts and thermal mismatch of parts, which increases as a source of failure if a large number of parts are required for the pump.

Another problem with conventional pumps is that they are difficult to miniaturize because of the complexity of the parts and their interaction. Miniature pumps are increasingly required for a wide variety of applications including controlled liquid and gas supply, thermal management, cooling systems and vacuum control devices. An example of a vacuum pump application includes planet surface sampling missions where soil, rocks and other geological materials are collected. The samples are either analyzed remotely or returned to earth, which return requires a miniature pump to preserve the samples in either a vacuum or inert atmosphere.

The performance of conventional pumps also degrades with decreasing temperature because of increases in thermal mismatch of parts. Maintaining low temperature performance is becoming increasingly important because of the growing number of low temperature applications such as the planetary missions mentioned previously. In addition to sample collection, such missions use remote analysis instruments, such as mass spectrometers, that require a vacuum be formed in a sample chamber for analysis.

In addition, there are increasing applications that require pumping mechanisms that are low cost, low in mass, consume low power and operate reliably in low ambient pressure.

Thus, it is an object of the invention to provide a pump device with few moving parts to improve operating reliability and to facilitate the miniaturization of the mechanism.

It is another object of the invention to provide a pump whose performance is maintained at low temperature and low ambient pressures.

Further, it is an object of the invention to provide a pump having a small number of components that are light weight, inexpensive and consume low amounts of power.

SUMMARY OF THE INVENTION

The present invention provides a pump for inducing a displacement of a fluid from a first medium to a second medium, including a conduit coupled to the first and second media, a transducing material piston defining a pump chamber in the conduit and being transversely displaceable for increasing a volume of the chamber to extract the fluid from the first medium to the chamber and for decreasing the chamber volume to force the fluid from the chamber to the second medium, a first transducing material valve mounted in the conduit between the piston and the first medium and being transversely displaceable from a closed position to an open position to admit the fluid to the chamber, and control means for changing a first field applied to the piston to displace the piston for changing the chamber volume and for changing a second field applied to the first valve to change the position of the first valve.

BRIEF DESCRIPTION OF THE DRAWINGS

FIG. 2 is a table illustrating the steps in an operation cycle of the pump of the invention.

DETAILED DESCRIPTION OF THE PREFERRED EMBODIMENT

Figure 1:
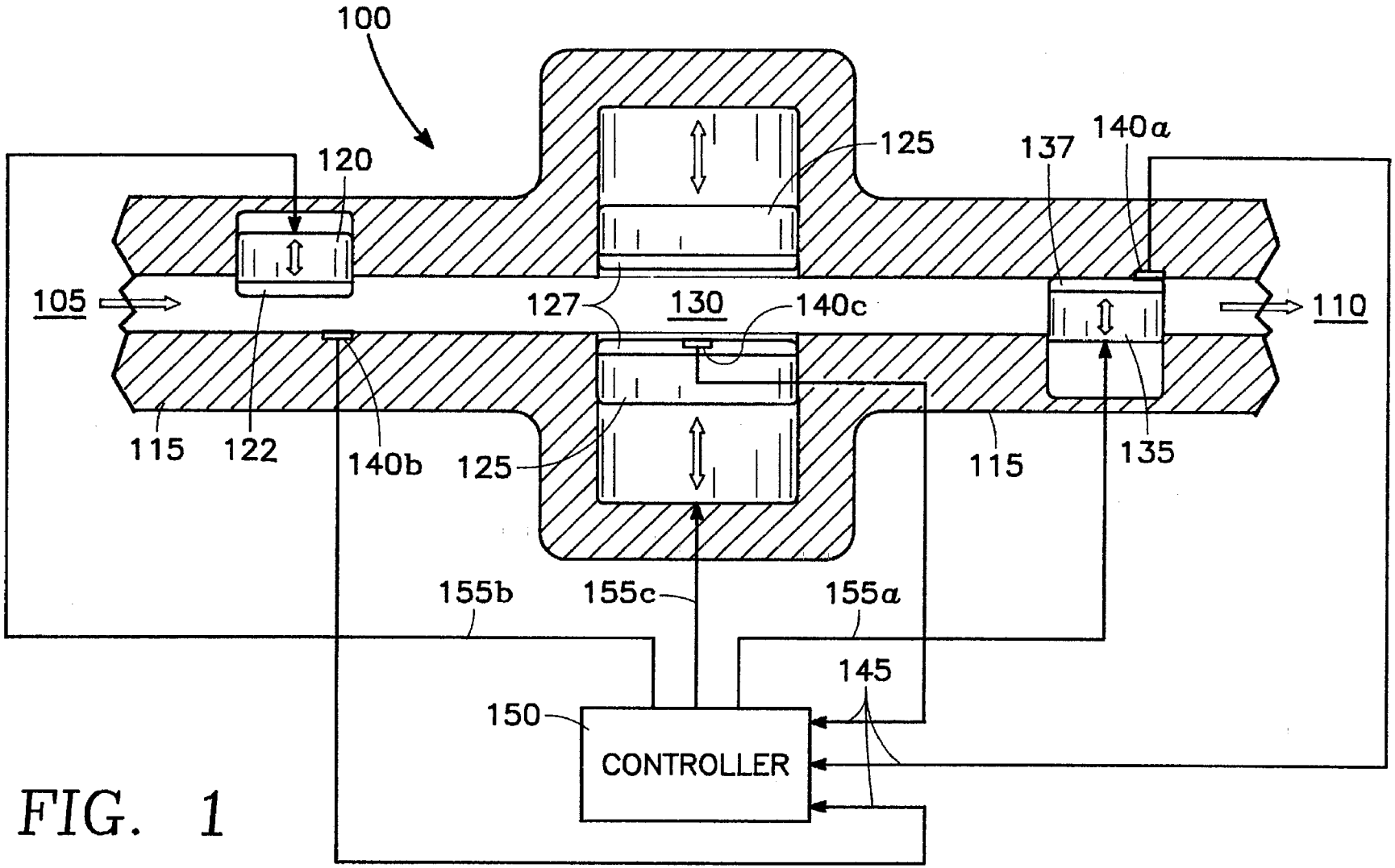
FIG. 1 is a cross section view of a pump according to the present invention.

A pump 100 of the present invention is shown in FIG. 1. A medium 105 contains a fluid that is to be transferred to a medium 110. A tube or conduit 115 connects the medium 105 to an transducing material valve 120, which is shown in the open position. The valve 120 consists of a stack actuator made from a transducing material such as a magnetostrictive or electroactive material.

Stack actuators that would be suitable for the valve 120 are commercially available and designed to expand in height when an electric or magnetic field is applied. For example, the actuators may be formed with a stack of thin dielectric wafers or layers instead of a single wafer because the amount of expansion is related to the electric field induced in the wafer. Since the field induced in each wafer is directly related to the applied voltage and inversely related to the thickness of the wafer, many thin wafers stacked together will produce a greater expansion than a single wafer of comparable thickness. The use of a stack also allows the high electric field required to be induced with a low voltage and current, for example less than 100 volts and several milliamps.

Stack actuators of the type described can achieve displacements of approximately 10 to 20 microns depending on the type of transducing material and the length of the stack. A typical electroactive actuator of this type is a piezoelectric stack actuator made by Morgan Matroc, Inc. of Bedford, Ohio. A piezoelectric stack actuator may be advantageous for certain applications because the field-induced strain changes sign upon field reversal, which will provide a greater difference in volume with which to induce the flow of fluid. This behavior is in contrast to stack actuators made of electrostrictive material in which the field-induced strain is independent of field reversal. A typical magnetostrictive actuator of this type is one sold by Etrema, Inc. of Ames, Iowa made from Terfenol-D. However, the choice between a magnetostrictive and electroactive material for the actuator will depend on design factors such as available voltage and current, size and operating conditions such as temperature and pressure.

Since many electroactive materials are brittle, a cap 122 may be disposed on a face of the actuator 120 contacting the conduit 115, which cap is made of a stiff and deformable material such as brass, teflon or nylon. The cap 122 will prevent the actuator from being damaged when it contacts the conduit 115 and also provide a seal to prevent the passage of fluid.

After passing the open valve 120, the fluid encounters one or more transducing material pistons 125. The pistons 125 may be made of the same type of materials used to make the valve 120, as described previously. The pistons may also include caps 127, similar to the caps 122. Two opposing pistons 125 are illustrated in FIG. 1 and are shown in contracted positions, thus inducing the fluid to flow into the expanded volume 130. In an expanded position, the pistons 125 would force fluid out of the chamber 130 in a pumping action. Alternatively, one piston 125 could be used, but it would produce a smaller volume of the pump chamber 130 resulting in a smaller volume of fluid pumped.

A second transducing material valve 135 may be positioned in the conduit 115 opposite the pistons 125. When the valve 135 is in the closed position as shown in FIG. 1, it prevents fluid from flowing into or out of the medium 110. Again, the valve 135 may be a stack actuator and include a cap 137, both as described previously.

Pressure sensors 140*a*, 140*b* and 140*c* are mounted on either the walls of the conduit 115 adjacent the valves 120, 135 or piston 125, or on the face of the piston 125 if two opposed pistons are used (as shown in FIG. 1). The sensors 140 provide sensor signals 145 indicating that either the valves 120, 135 or piston 125 is in contact with the walls of the conduit 115 or the opposed pistons 125 are in contact, thus obstructing the flow of the fluid. These sensor signals 145 are used by a control circuit 150 described below to provide a sequence of electric signals to the valves 120, 135 and pistons 125 to induce the flow of fluid by means of dimensional changes of the valves 120, 135 and pistons 125. Many conventional types of devices are suitable for use as sensors 140, such as a force sensitive resistor made by Interlink, Inc. of Camarillo, Calif.

The sensors 140 may also be used to sense leaks or failure of the pump 100 depending on the type or location of device used. For example, the force sensitive resistor described previously is capable of detecting pressures in the range of 0.1 to 150 psi. Thus, the sensors 140*c* can be used to monitor a pressure in the chamber 130 when the pistons 125 are not contacting one another, i.e., in an intake step of the pump 100 operation. Further, the sensors 140*a* and 140*b* can be used to monitor the physical integrity of the conduit 115 during the operation of the pump 100.

A controller 150 receives the sensor signals 145 and compares them to a preprogrammed sequence of control signals 155*a*, 155*b*, and 155*c* to determine which control signal should be transmitted to each of the valves 120, 135 or pistons 125 and at what time. The control signals 155 consist of an electric potential specified by the manufacturer of the particular transducing material actuator, for example less than 100 volts, at a frequency also limited by the particular stack actuator. For example, a typical actuator of this type can respond, i.e., expand and either relax (electrostrictive) or contract (piezoelectric), at a frequency of approximately 10 KHz.

In general, the operation of a pump 100 of the invention uses the transducing material valves 120, 135 and one or more transducing material pistons 125 each having a face contacting either a wall of the conduit 115 or an adjacent face of one of the valves 120, 135 or pistons 125. A preprogrammed sequence of control signals 155 opens and closes the valves 120, 135 and pistons 125 to induce the flow of the fluid from medium 105 to medium 110.

FIG. 1 illustrates a first step in an operation cycle of the pump 100. Specifically, a control signal 155*a* is first transmitted by the controller 150 to valve 135 to expand the valve and close the portion of conduit 115 adjacent the valve 135 to prevent flow of the fluid to the medium 110. The sensor 140*a* transmits a sensor signal 145 to the controller 150 indicating that this portion of the conduit 115 has been closed. A control signal 155*b* is then disengaged from valve 120 in order to allow it to remain in a relaxed state, thus opening the portion of the conduit 115 adjacent to the valve 120 to allow the fluid to flow into the chamber 130. If the valve 120 were a piezoelectric stack actuator, however, a negative potential control signal 155*b* could be applied to contract the valve 120, thus providing a larger cross section opening of the conduit 115 through which to pass fluid. Alternatively, the piezoelectric stack actuator could be disposed so that the valve 120 would be in a relaxed or closed position with no electric potential applied, and contracted or opened when a negative potential is applied. This option has the advantage of causing the pump 100 to be sealed when no power is applied, as described subsequently.

After the valves 120, 135 are thus opened and closed, respectively, a control signal 155*c* is then disengaged from the pistons 125 to allow them to transition to a contracted state, thus increasing the volume of the chamber 130. This increased volume induces fluid to flow into the chamber. After the pistons 125 have fully relaxed (or contracted if a negative potential control signal 155*c* were applied to pistons 125 made of piezoelectric stack actuators), a control signal 155B is transmitted to valve 120 to expand the valve and close the adjacent portion of the conduit 115 preventing the fluid from flowing back to the medium 105. The sensor 140*b* then transmits the sensor signal 145 to the controller 150 indicating that this portion of the conduit 115 has been closed.

The control signal 155*a* previously applied to the valve 135 is then disengaged allowing the valve 135 to relax and open the portion of the conduit 115 adjacent the valve, allowing the fluid to pass to the medium 110. The control signal 155*c* is then applied to the pistons 125 to expand and reduce the volume of the chamber 130 which volume reduction forces the fluid through the conduit 115 into medium 110. The sensor 140*c* then transmits the sensor signal 145 to the controller 150 indicating that the volume of the chamber 130 has been minimized either by the faces of the pistons 125 contacting one another (for two opposed pistons) or by the face of one piston 125 contacting a wall of the conduit 115. This action completes a full cycle of the pump 100.

This operation cycle of the pump 100 is illustrated by the input signal-output signal table shown in FIG. 2, which relates the input signals 145 received by the controller 150 to the output signals 155 generated by the controller 150 (shown in FIG. 1). At Step 1 the input signals 145 from sensors 140B and 140A indicate open and closed positions of valves 120 and 135, respectively, and the input signal 145 from the sensor 140C indicates a contracted position of the pistons 125. When these Step 1 input signals are received by the controller 150, the controller generates and transmits output signal 155*b* to start closing valve 120 and output signal 155*a* to start opening valve 135. These output signals 155*b* and 155*a* are maintained until the input signals indicated at Step 2 are received.

At Step 2 the input signals 145 from sensors 140*b* and 140*a* indicate closed and open positions of valves 120 and 135, respectively, and the input signal 145 from the sensor 140*c* continues to indicate a contracted position of the pistons 125. When these Step 2 input signals are received by the controller 150, the controller generates and transmits an output signal 155*c* to start expanding the pistons 125 to reduce the volume of the chamber 130, forcing the fluid into the medium 110. This output signal 155*c* is maintained until the input signals indicated at Step 3 are received.

At Step 3 the input signals 145 from sensors 140*b* and 140*a* continue to indicate closed and open positions of valves 120 and 135, respectively, and the input signal 145 from the sensor 140*c* indicates an expanded position of the pistons 125. When these Step 3 input signals are received by the controller 150, the controller generates and transmits output signal 155*b* to start opening valve 120 and output signal 155*a* to start closing valve 135. These output signals 155*b* and 155*a* are maintained until the input signals indicated at Step 4 are received.

At Step 4 the input signals 145 from sensors 140*b* and 140*a* indicate open and closed positions of valves 120 and 135, respectively, and the input signal 145 from the sensor 140*c* continues to indicate an expanded position of the pistons 125. When these Step 4 input signals are received by the controller 150, the controller generates and transmits an output signal 155*c* to start contracting the pistons 125 to increase the volume of the chamber 130, inducing the fluid to flow into the chamber 130 form the medium 105, This output signal 155*c* is maintained until the input signals indicated at Step 1 are received, at which time the cycle repeats. The controller 150 (shown in FIG. 1) could be implemented with a read-only-memory programmed with a program in accordance with the table in FIG. 2.

To provide an example of the performance that can be obtained with the pump 100, sample dimensions and operating parameters are provided. Piezoelectric stack actuators could be used as valves 120, 135 and pistons 125, such as the actuators made by Morgan Matroc, Inc. For example, if a Model PZT-5H stack actuator were provided in a circular configuration having a diameter of 20 mm and a height of 20 mm, a nominal positive expansion of approximately 20 microns would be obtained using a potential of approximately 250 volts at only 20 to 50 milliamps of current. If two of these actuators were placed in an opposing configuration of pistons 125 (as shown in FIG. 1), a total displaced volume would be approximately 196 $mm^3$. If these pistons 125 were activated by control signals 155 having a frequency of approximately 10 KHz, a pumping rate of approximately 2 liters per second can be attained.

As described previously, magnetostrictive materials may also be used for the valves 120, 135 and pistons 125, and have the advantage of operating at very low temperatures of less than 100 degrees Kelvin. Such magnetostrictive actuators expand under application of a magnetic field. For example, a magnetostrictive actuator made by Etrema, Inc. and having a length of 60 mm can achieve a 15 micron displacement upon application of current of approximately seven amps at approximately 100 volts.

In addition to the objects described previously, a pump of the invention may be configured to accomplish an additional novel self-holding feature. At least one of the valves 120, 135 (shown in FIG. 1) may be selected to be in a closed position when a zero electric potential is applied. For example, one of the valves may be selected to be a piezoelectric stack actuator that contracts to an open position upon application of a negative electric field and relaxes to a closed position upon removal of the field. This configuration has the advantage that the pump would be sealed upon removal of power. In addition, this feature has a fail-safe component because if power were lost in an emergency, the pump would be sealed to prevent leakage under these conditions.

Although the present invention has been described with reference to preferred embodiments, workers skilled in the art will recognize that changes may be made in form and detail without departing from the spirit and scope of the invention.

What is claimed is:

1. A pump for inducing a displacement of a fluid from a first medium to a second medium, comprising:

a conduit coupled to said first and second media;

a transducing material piston defining a pump chamber in said conduit and being transversely displaceable for increasing a volume of said chamber to extract said fluid from said first medium to said chamber and for decreasing said chamber volume to force said fluid from said chamber to said second medium;

a first transducing material valve mounted in said conduit between said piston and said first medium and being transversely displaceable from a closed position to an open position to admit said fluid to said chamber; and control means for changing a first field applied to said piston to displace said piston for changing said chamber volume and for changing a second field applied to said first valve to change the position of said first valve.

2. The pump of claim 1 wherein said piston comprises one of a magnetostrictive actuator and said first field comprises a magnetic field.

3. The pump of claim 1 wherein said piston comprises an electroactive actuator and said first field comprises an electric field.

4. The pump of claim 3 wherein said electroactive actuator comprises one of an electrostrictive actuator and a piezoelectric actuator.

5. The pump of claim 1 wherein said piston comprises a stack actuator.

6. The pump of claim 1 wherein said piston further comprises a pair of opposing pistons.

7. The pump of claim 1 wherein said piston further comprises a cap made of a softer material than said piston.

8. The pump of claim 1 wherein said first valve comprises a magnetostrictive actuator and said second field comprises a magnetic field.

9. The pump of claim 1 wherein said first valve comprises an electroactive actuator and said second field comprises an electric field.

10. The pump of claim 9 wherein said electroactive actuator comprises one of an electrostrictive actuator and a piezoelectric actuator.

11. The pump of claim 1 wherein said first valve comprises a stack actuator.

12. The pump of claim 1 wherein said first valve further comprises a cap made of a softer material than said valve.

13. The pump of claim 1 wherein said conduit has an interior surface and said first valve has a face opposing said interior surface and further comprising:

a pressure sensor disposed between said valve face and said interior surface.

14. The pump of claim 1 wherein said conduit has an interior surface and said piston has a face opposing said interior surface and further comprising:

a pressure sensor disposed between said face and said interior surface.

15. The pump of claim 6 wherein one of said pistons has a face opposing said other piston and further comprising:

a pressure sensor disposed between said face and said other piston.

16. The pump of claim 1 further comprising:

a second transducing material valve mounted in said conduit between said piston and said second medium and being transversely displaceable from a closed position to an open position to admit said fluid to said second medium; and wherein said control means further comprises means for changing a third field applied to said second valve to change the position of said second valve.

17. The pump of claim 1 wherein the changing of said chamber volume is caused by a movement of said piston.

18. The pump of claim 1 wherein the changing of said chamber volume is caused by a change in size of said piston.

19. A pump for inducing a displacement of a fluid from a first medium to a second medium, comprising:

a conduit coupled to said first and second media;

a first transducing material valve mounted in said conduit and transversely displaceable from a closed position to an open position to admit said fluid to said chamber;

a transducing material piston defining a pump chamber in said conduit between said first valve and said second medium and transversely displaceable from a first position to a second position to extract said fluid from said first medium into said chamber and from said second position to said first position to force said fluid from said chamber to said medium; and control means for changing a first field applied to said piston to displace said piston and for changing a second field applied to said first valve to change the position of said valve.

20. The pump of claim 19 wherein said piston comprises one of a magnetostrictive actuator and said first field comprises a magnetic field.

21. The pump of claim 19 wherein said piston comprises an electroactive actuator and said first field comprises an electric field.

22. The pump of claim 21 wherein said electroactive actuator comprises one of an electrostrictive actuator and a piezoelectric actuator.

23. The pump of claim 19 wherein said piston comprises a stack actuator.

24. The pump of claim 19 wherein said piston further comprises a pair of opposing pistons.

25. The pump of claim 19 wherein said first valve comprises a magnetostrictive actuator and said second field comprises a magnetic field.

26. The pump of claim 19 wherein said first valve comprises an electroactive actuator and said second field comprises an electric field.

27. The pump of claim 19 wherein said electroactive actuator comprises one of an electrostrictive actuator and a piezoelectric actuator.

28. The pump of claim 19 wherein said first valve comprises a stack actuator.

29. The pump of claim 19 further comprising:

a second transducing material valve mounted in said conduit between said piston and said second medium and transversely displaceable from a closed position to an open position to admit said fluid to said second medium; and wherein said control means further comprises means for changing a field applied to said second electroactive valve to change the position of said second valve.

30. A pump for inducing a displacement of a fluid from a first medium to a second medium, comprising:

a conduit coupled to said first and second media;

a transducing material piston defining a pump chamber in said conduit and being transversely displaceable, said piston comprising means for changing a volume of said chamber;

a transducing material valve mounted in said conduit between said piston and said first medium and transversely displaceable from a closed position to an open position; and control means for changing fields applied to said piston and said valve in a predetermined sequence to alternately extract said fluid from said first medium into said chamber and to force said fluid from said chamber into said second medium.

31. The pump of claim 30 wherein said predetermined sequence comprises:

applying a first set of fields to open said valve and to increase said chamber volume to extract said fluid from said first medium into said chamber; and applying a second set of fields to close said valve and to decrease said chamber volume to force said fluid from said chamber to said second medium.

* * * * *